US007020913B2

(12) United States Patent
Van Scheppingen et al.

(10) Patent No.: US 7,020,913 B2
(45) Date of Patent: Apr. 4, 2006

(54) HOIST DEVICE

(75) Inventors: Mattheas Robertus Van Scheppingen, Hubhorst (NL); Dennis Tjalling Huizenga, Nunspeet (NL)

(73) Assignee: Exodus Holding B.V., Nunspeet (NL)

( * ) Notice: Subject to any disclaimer, the term of this patent is extended or adjusted under 35 U.S.C. 154(b) by 4 days.

(21) Appl. No.: 10/757,099

(22) Filed: Jan. 14, 2004

(65) Prior Publication Data

US 2005/0088004 A1 Apr. 28, 2005

(30) Foreign Application Priority Data

Jan. 24, 2003 (NL) ..... 1022487

(51) Int. Cl.
*A61G 7/10* (2006.01)

(52) U.S. Cl. ..... 5/86.1; 5/81.1 R; 24/648; 24/701

(58) Field of Classification Search ..... 5/83.1 R, 5/83.1, 86.1, 89.1; 24/647–648, 701; 292/31, 292/54, 304, 341.17
See application file for complete search history.

(56) References Cited

U.S. PATENT DOCUMENTS

| | | | | |
|---|---|---|---|---|
| 4,545,085 A | * | 10/1985 | Feldt | 5/87.1 |
| 4,802,542 A | * | 2/1989 | Houston et al. | 180/65.5 |
| 5,201,858 A | | 4/1993 | Otrusina | |
| 6,053,519 A | * | 4/2000 | Poindexter et al. | 280/250.1 |

FOREIGN PATENT DOCUMENTS

| | | |
|---|---|---|
| EP | 1 064 906 | 1/2001 |
| GB | 2 293 857 | 4/1996 |
| WO | 97/01319 | 1/1997 |

* cited by examiner

*Primary Examiner*—Heather Shackelford
*Assistant Examiner*—Fredrick Conley
(74) *Attorney, Agent, or Firm*—Ladas and Parry LLP

(57) ABSTRACT

Hoist device for persons comprising a lifting arm to which a headed stud is attached for attaching a hoist sling to the lifting arm, wherein the head has a larger diameter than the stud, and wherein the hoist sling comprises an attachment device for attaching the hoist sling to the lifting arm, comprising a plate-shaped part comprising:

a continuous slot situated in a plane of the plate-shaped part comprising a first portion through which the stud and its head will pass, a second portion through which the stud will but the head of the stud will not pass, and a connection portion between the first and second portion, and a locking device arranged to the plate-shaped part and movable parallel to the plane of the plate-shaped part, which locking device near a first end comprises a closing member and near a second end comprises an operation member that can be operated for bringing the closing member from a first position, in which the closing member closes off the connection portion, to a second position, in which the closing member has been slid out of the connection portion for clearing the connection portion for moving the stud from the second to the first portion in the slot.

17 Claims, 6 Drawing Sheets

HOIST DEVICE

The invention relates to a hoist device, particularly a hoist device for persons, also called a transfer lift.

The invention furthermore relates to an attachment device for a hoist sling, also called lifting sling, with which the hoist sling can be attached to the hoist device, and to a hoist sling provided with such an attachment device.

Especially when using the hoist device for lifting a semi-valid person or an invalid it is of importance that the attachment device of a hoist sling that supports the person, cannot inadvertently be opened or disengage from the hoist device.

WO 97/01319 describes a fastening for hoist slings comprising a holder provided with a plate-shaped part and a round stud having a round head wherein the head has a larger diameter than the stud, and a resilient element of which a portion projects above the face of the plate-shaped part. The fastening furthermore comprises a plate-shaped clip provided with a slot which has a first portion through which the head of the stud will pass and a second portion through which the stud will pass, but the head of the stud will not pass. If the fastening has to be closed, the first portion of the clip is placed over the stud of the holder. The resilient element of the holder here is pressed in by the plate-shaped clip. Subsequently the clip is moved so that the stud ends up in the second portion of the clip in a position in which the resilient element of the holder springs back. The resilient element blocks the sliding back of the clip.

A disadvantage of the known fastening is that it is not user-friendly. In the known device the operation member and the closing member are combined in the resilient element. As a result the known fastening is for instance difficult to open because the resilient element on the holder has to be pressed in manually, and while pressing in, the clip has to be slid over the resilient element. In case of an emergency the known fastening thus is not easily and quickly unlocked. Moreover the person trying to open the known closure may get his/her fingers wedged.

It is an object of the present invention to improve on this.

From one aspect the invention to that end provides a hoist device for persons comprising a lifting arm to which a headed stud is attached for attaching a hoist sling to the lifting arm, wherein the head has a larger diameter than the stud, and wherein the hoist sling comprises an attachment device for attaching the hoist sling to the lifting arm, comprising a plate-shaped part comprising:

- a continuous slot situated in a plane of the plate-shaped part comprising a first portion through which the stud and its head will pass, a second portion through which the stud will but the head of the stud will not pass, and a connection portion between the first and second portion, and
- a locking device arranged to the plate-shaped part and movable parallel to the plane of the plate-shaped part, which locking device near a first end comprises a closing member and near a second end comprises an operation member that can be operated for bringing the closing member from a first position, in which the closing member at least partially closes off the connection portion, to a second position, in which the closing member has been slid out of the connection portion for clearing the connection portion for moving the stud from the second to the first portion in the slot.

The locking device in the first position ensures adequate closing off of the connection portion and ensures that the attachment device cannot be inadvertently be opened and/or disengage from the lifting arm. The closing member, which at least partially closes off the connection portion, blocks a passage of the stud through the connection portion. The locking device may by operation of the operation member be slid from said first position to a second position in which the connection portion is opened, as a result of which the stud can be slid through the connection portion and the attachment device can be detached from the lifting arm.

In the device according to the invention the locking device comprises a closing member near a first end, and an operation member near a second end. Thus the operation member can be placed further away from the closing member, as a result of which the operation of the operation member does not interfere with the opening of the attachment device, due to which the attachment device according to the invention is easy to operate and the risk of fingers getting wedged is reduced.

Another advantage of the device according to the invention in comparison to the known device is that the attachment device according to the invention comprises only one loaded part, namely the plate-shaped part. Therefore only one part needs to be made solid and firm instead of two as is the case in the known device. As a result the production costs of the device according to the invention will be lower.

In an embodiment of the hoist device according to the invention the locking device is rotatably attached to the plate-shaped part. Preferably the point of rotation is placed between the first and second end of the locking device. This results in a simple structure of the movable locking device which only at the location of the point of rotation has to be connected to the plate-shaped part.

Preferably the operation member is situated near a side of the plate-shaped part. It is furthermore advantageous here if the operation member is operable from the side of the plate-shaped part. Thus the attachment device can be operated from both sides of the plate-shaped part, and a univocal orientation of the attachment device according to the invention during attachment to the lifting arm is not necessary.

Preferably the side is situated in a longitudinal direction of the slot and lateral from the slot. Thus the operation of the operation member will not interfere with the hoist sling which in the extension of the slot is attached to the plate-shaped part. Said embodiment is particularly advantageous in combination with a rotatably placed locking device that is operable from the side of the plate-shaped part. The operation member then is situated in the squeeze plane of the attachment device. By pressing the operation member in the direction of the plate-shaped part, the closing member will give way in the direction of the side and thus clear the connection portion of the slot, which ensures a highly user-friendly operation.

In an embodiment the attachment device comprises a biassing device for biassing the locking device to the first position. Preferably the biassing device comprises a spring. The locking device can thus be automatically pressed into the closing position, which further increases the ease of operation and the safety of the device according to the invention.

In an embodiment of the hoist device according to the invention the locking device is adapted for giving way from the first position to a stud which moves in the slot from the first to the second portion. The attachment device can thus be easily and quickly attached to the lifting arm without the operation member having to be operated. Preferably the closing member at a side facing the first portion of the slot is provided with an inclined edge sloping in the direction of the second portion.

In a further embodiment the attachment device is adapted for a self-locking closing-off of the connection part by the closing member. The closing member is for instance urged further into the first position, being the closing position, by a pressure of the stud that is situated in the second portion, in the direction of the first portion of the slot.

Preferably the locking device is movably attached for a movement of the closing member directed away from the first portion from the first position and in which the attachment device comprises a stop for stopping a movement of the closing member directed towards the first portion from the first position. Chances of the attachment device inadvertently being opened and/or getting detached from the hoist device are further reduced with this embodiment which further increases the safety of the device according to the invention.

Preferably an engagement surface of the operation member is substantially perpendicular to the plane of the plate-shaped part. Via this engagement surface of the operation member the locking device is easily movable in a direction parallel to the plane of the plate-shaped part.

Preferably the attachment device comprises a further stop for stopping the movement of the locking device when the closing member is moved outside of the connection portion. The stroke of the locking device is thus optimally limited.

In a further embodiment of the hoist device according to the invention the attachment device comprises two locking devices that are placed on either side of the connection portion of the slot. Both locking devices cooperate for closing off the connection portion of the slot. For allowing a movement of the stud from the second to the first portion of the slot, both locking device have to be slid out of the connection portion. Chances of the attachment device inadvertently being opened and/or getting detached from the lifting arm are further reduced with this embodiment. The safety of the device according to the invention is thus further increased.

A further advantage of the use of two locking devices is that the stroke of each locking device can be smaller than the stroke of one single locking device. This may further improve the ease of use.

If moreover the operation member of both locking devices comprises an engagement surface that is substantially perpendicular to the plane of the plate-shaped part and is situated near opposite sides of the plate-shape part, a squeezing motion of a hand that engages over the plate-shaped part, can operate both locking devices simultaneously.

From a further aspect the invention provides an attachment device for a hoist sling, with which the hoist sling is attachable to a hoist device, comprising:

a plate-shaped part provided with a continuous slot which comprises a first portion through which a headed stud fits, wherein the head has a larger diameter than the stud, a second portion through which the stud does but the head does not fit, and a connection portion between the first and second portion, a locking device which is attached to the plate-shaped part and movable parallel to a plane of the plate-shaped part in which the slot is situated, wherein the locking device near a first end comprises a closing member and near a second end comprises an operation member that is operable for sliding the locking device from a first position, in which the closing member at least partially closes off the connection portion, to a second position, in which the closing member has been slid out of the connection portion for clearing the connection portion for a movement of the stud from the second to the first portion in the slot.

The invention furthermore provides an attachment device suitable and intended for a hoist device according to the invention.

The invention furthermore provides a hoist sling suitable and intended for a hoist device according to the invention.

The invention will be elucidated on the basis of the exemplary embodiment shown in the attached drawings, in which.

Figure 3:
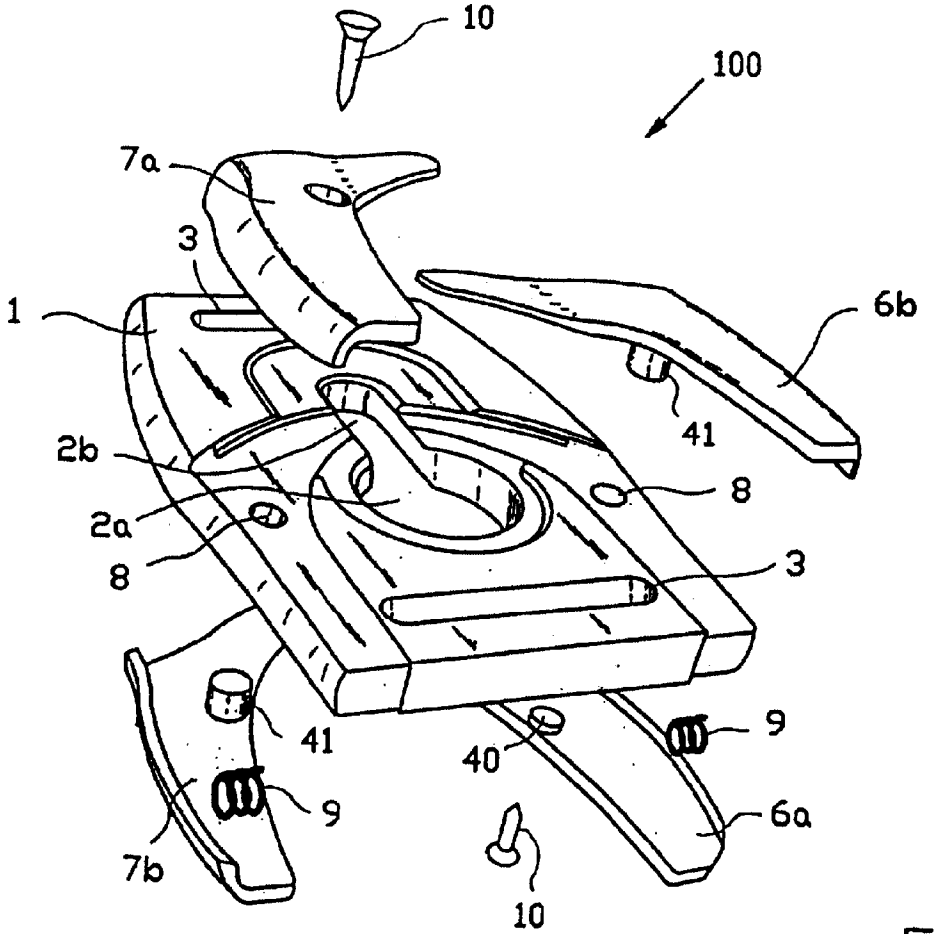
FIG. 3 shows a schematic exploded view of an exemplary embodiment of the device according to the invention.
Figure 6B:
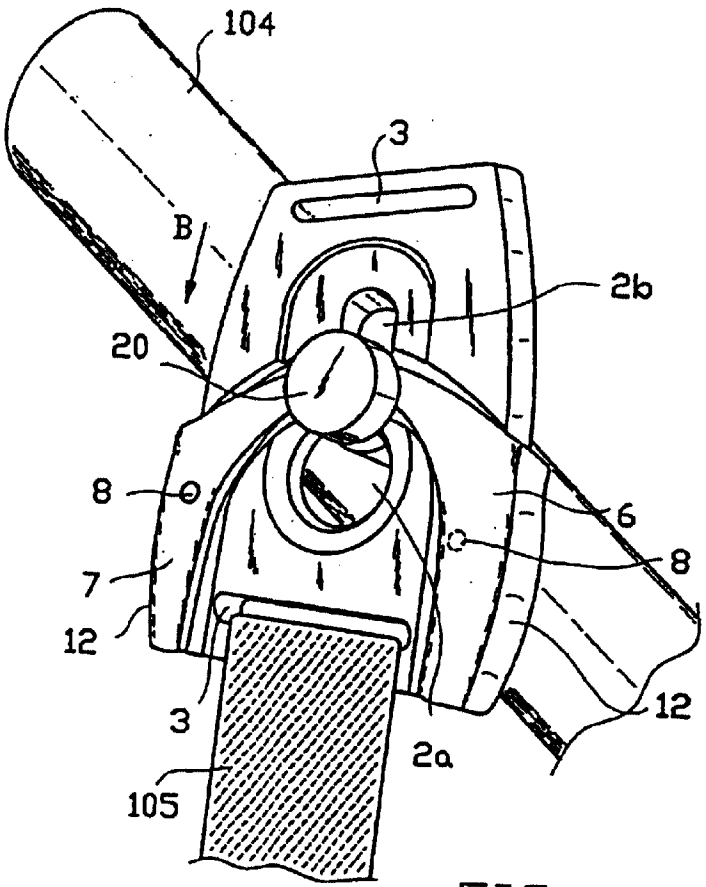
Figure 6A:
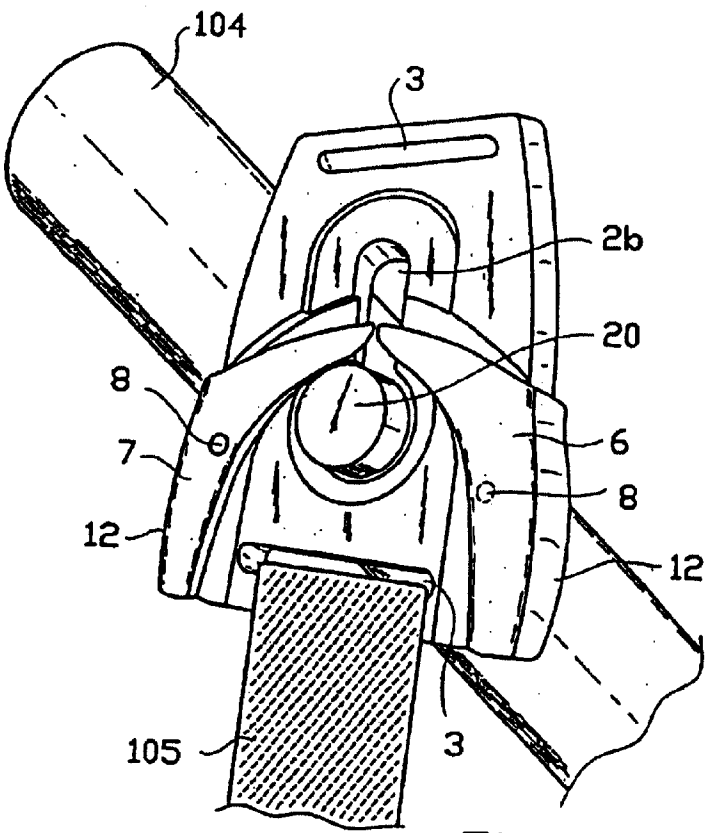
Figure 7:
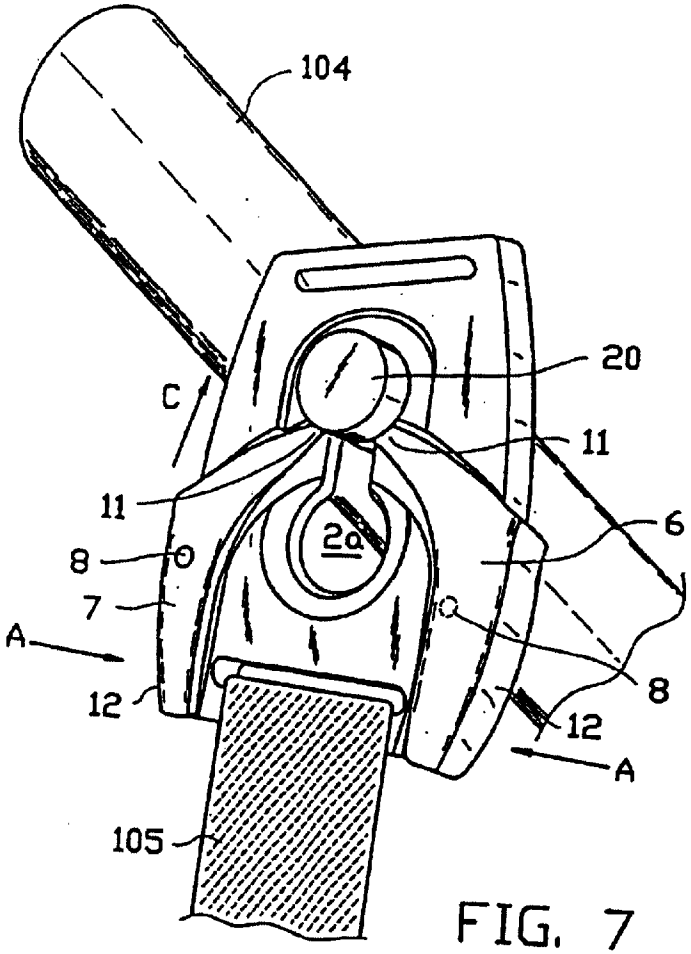
Figure 6C:
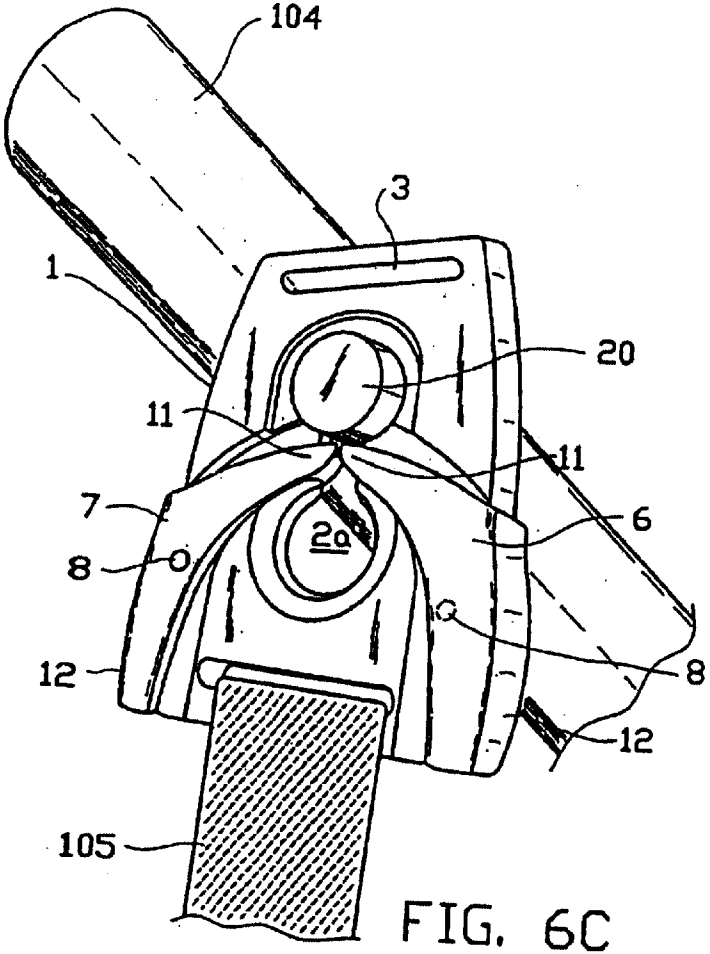

FIGS. 6A–C show a schematic view of the arrangement of the embodiment as shown in FIG. 3 over a headed stud; and FIG. 7 shows a schematic view of the opening of the attachment device for detaching the stud.

Figure 1:
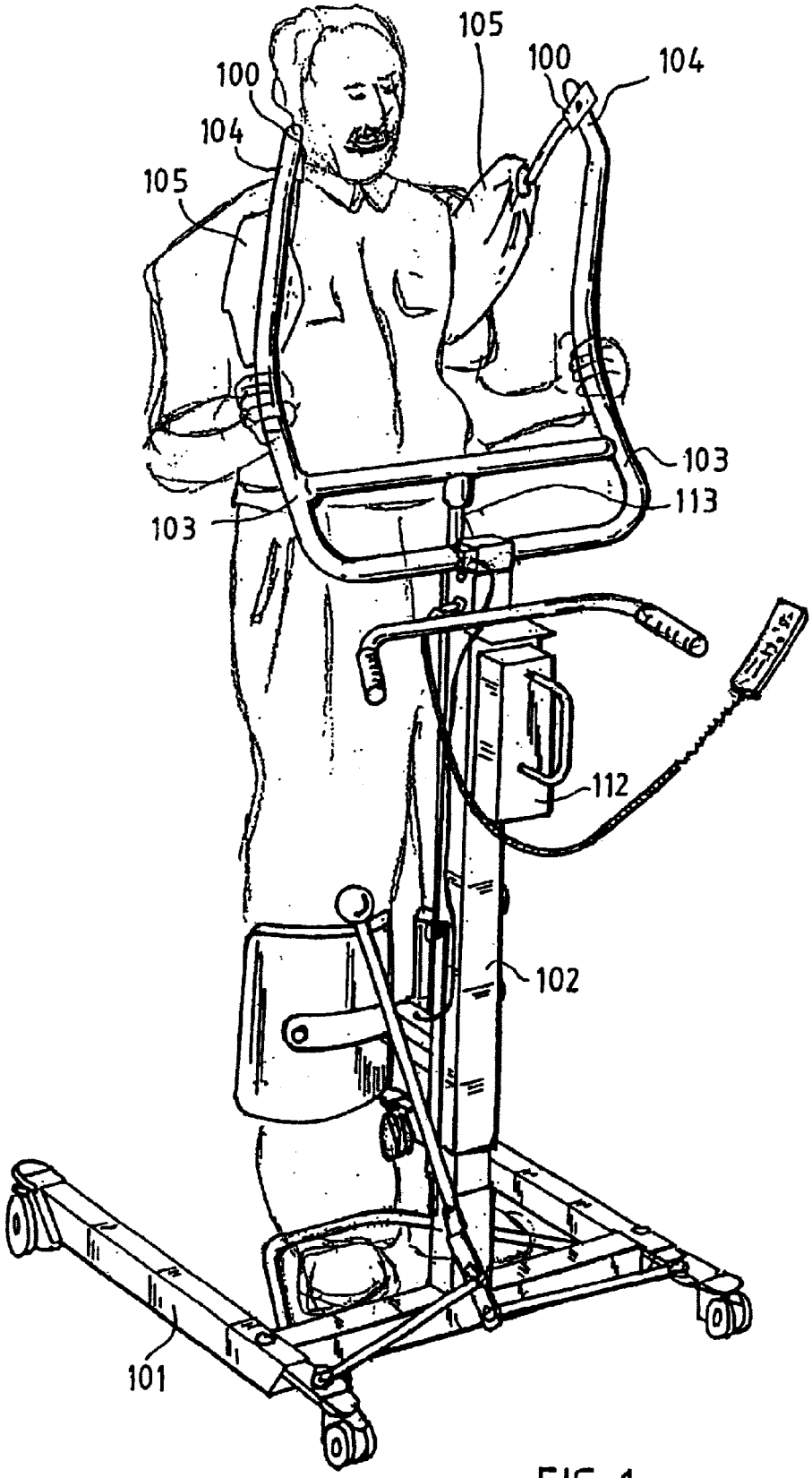
FIGS. 1 and 2 show a schematic view of a hoist device for semi-valid persons.
Figure 2:
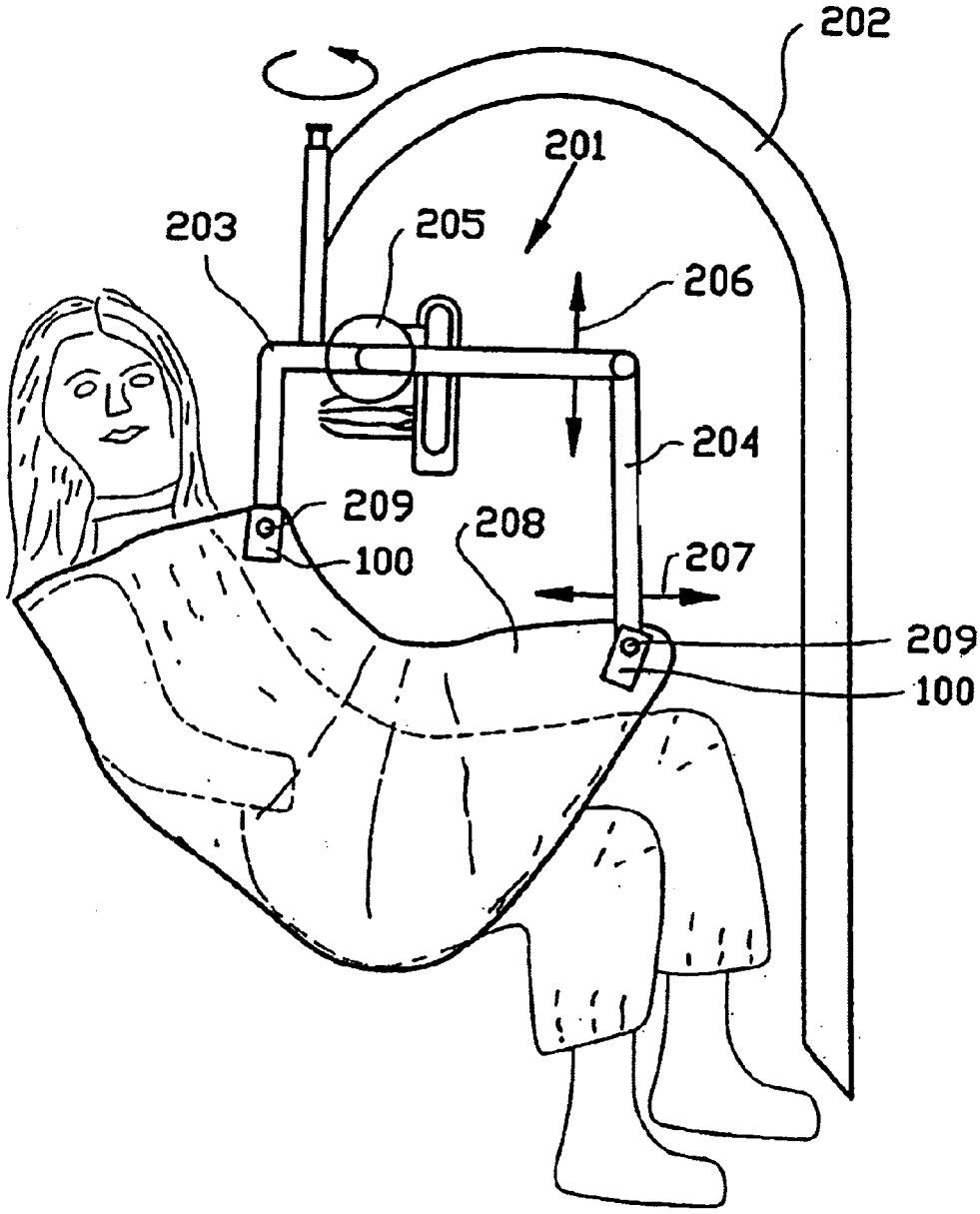

Two exemplary embodiments of a hoist device according to the invention are shown in FIGS. 1 and 2.

FIG. 1 shows a hoist device and particularly a transfer lift in the form of an active standing lift. Said first exemplary embodiment is used for lifting a semi-valid or ill person from a sitting position into a substantially standing position. Said transfer lift is provided with a mobile frame 101 provided with a vertical post or mast 102. The vertical post 102 is provided with lifting arms 103. The lifting arms 103 are driven by means of a motor 112, which may optionally be provided with a battery. The lifting arms 103 are furthermore provided with a gas spring 113, which engages the lifting arms 103 and the vertical post 102. The gas spring 113 serves to compensate a part or the full weight of the patient as a result of which the electro motor 112 does not have to lift the full weight. A hoist sling 105 is coupled to the lifting arms 103, which hoist sling is attached by positioning it behind the back and under the arms of the patient. Said hoist sling 105 can be attached to the lifting arms 103 using an attachment device 100. For that purpose the ends 104 of the lifting arms 103 are provided with a headed stud for attaching the attachment device 100 to the lifting arms 103, the head having a larger diameter than the stud. At both its ends the hoist sling 105 is provided with an attachment device 100 as discussed below, which can be attached to the headed stud.

FIG. 2 shows a further hoist device and particularly a transfer lift in the form of a passive lift for patients. Said second exemplary embodiment comprises a carrying device 201 which is rotatably connected to an arched boom 202. The arched boom 202 can be mounted on a mobile frame (not shown). The carrying device 201 comprises permanent arms 203 and lifting arms 204 which at their ends are provided with a headed stud 209 for attaching the attachment device 100 to the lifting arms 203, 204, the head having a larger diameter than the stud. The lifting arms 204 comprise an upper arm that is coupled to a motor 205, and a lower arm that is hinged to the upper arm. The motor 205 can move the upper arm in vertical direction 206. The lower arm can move here in horizontal direction 207 under the influence of its own weight or the patient's weight. A hoist sling 208 provided with the attachment devices 100 as discussed below, can be attached to the headed studs 209.

The attachment device 100 comprises a plate-shaped, part 1 provided with a continuous slot 2*a*, 2*b* as shown in FIG. 3. The slot comprises a first portion 2*a* through which a headed stud will pass. The slot comprises a second portion 2*b* through which the stud will, but the head of the stud will not pass. The first portion 2*a* and the second portion 2*b* are connected to each other by a connection portion. The ends of the plate-shaped part 1 that lie in the extension of the slot 2*a*, 2*b*, are provided with openings 3 through which a hoist sling can be attached (not shown). The plate-shaped part 1 forms the carrying part of the attachment device. That means that all loads will be exerted on this part. Only at the contact surface with the head of the stud is the carrying part (the plate-shaped part 1) therefore thin enough so that the headed stud can be slid from the first portion 2*a* to the second portion 2*b* of the slot. In this exemplary embodiment the thickness of the carrying part on the contact surface of the head is approximately 5 mm. Furthermore the plate-shaped part 1 is thickened in order to guarantee a strong and therefore safe attachment device. This is both advantageous to flexural strain and tensile strain.

The attachment device furthermore comprises two locking devices 6, 7 which are placed on either side of the slot 2*a*, 2*b*. The locking devices 6, 7 are attached to the plate-shaped part 1 rotatable about a hinge point 8. The hinge points 8 consist of a combination of a press connection and a screw connection. Here both locking devices 6 and 7 consist of two parts 6*a*, 6*b* and 7*a*, 7*b*, respectively. Both parts 6*a* and 6*b* and 7*a* and 7*b*, respectively, are pressed onto each other over the plate-shaped part 1 with a so-called male-female connection 40, 41. Here the compression springs 9 are put directly into position. To render the connection permanent and safe both locking devices 6, 7 are also secured with stainless steel screws 10. The locking devices 6, 7 are urged into a closed position by the springs 9. Stainless steel compression springs are used here. Said springs are operationally reliable and are completely covered by the locking devices 6, 7.

Figure 4:
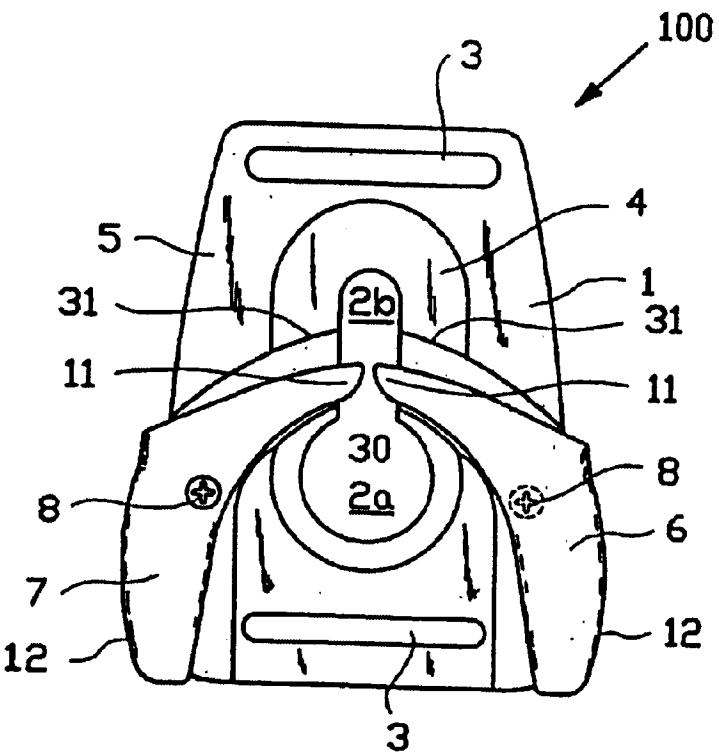
FIG. 4 shows a schematic view of the embodiment of FIG. 3 in non-operated condition.

FIG. 4 shows the exemplary embodiment of the attachment device 100 as shown in FIG. 3 in assembled condition. In the non-operated condition shown here, the stainless steel compression springs are under slightly biassed. During assembly of the attachment device they are placed between the two parts 6*a*, 6*b* and 7*a*, 7*b*, respectively, of the locking devices 6, 7. At a first end 11, both locking devices 6, 7 are provided with a closing member that at least partially closes off the connection portion. A second end of the locking devices 6, 7 has been provided with an operation member 12. The point of rotation 8 is placed here between the first end 11 and the second end 12. In this non-operated condition the connection portion of the slot is closed off by the closing members 11 of the locking devices 6, 7.

The locking screw near the point of rotation 8 of the left-hand locking device 7 shown in FIG. 4 is situated in the side shown here of the attachment device. The locking screw near the point of rotation 8 of the right-hand locking device 6 is situated at the other side of the attachment device and therefore shown in FIG. 4 by dotted lines.

In the non-operated condition shown in FIG. 4, the locking devices 6, 7 are biassed against the stops 30.

Figure 5:
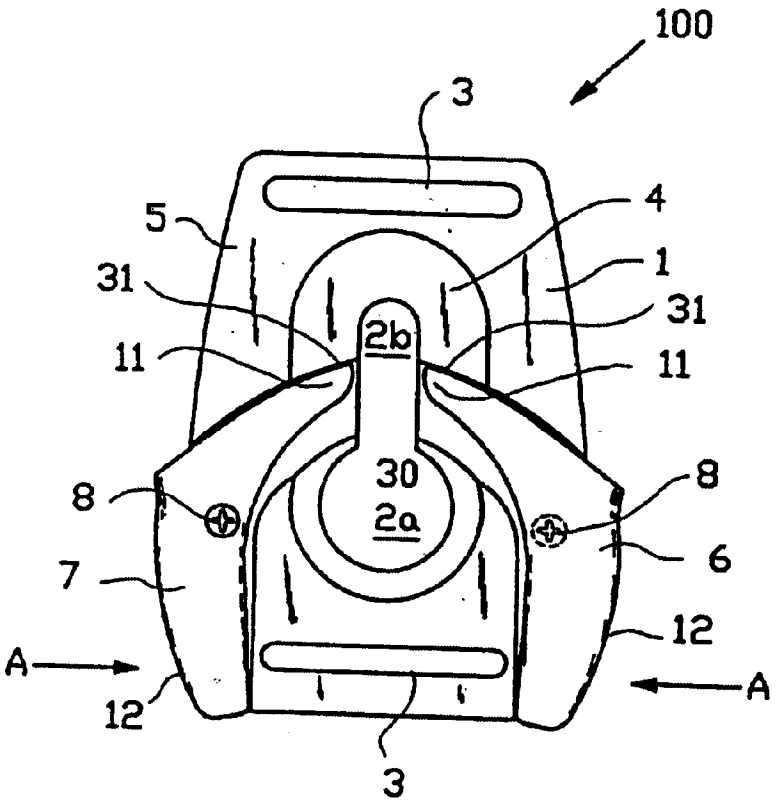
FIG. 5 shows a schematic view of the embodiment of FIG. 3 in opened condition.

After squeezing the locking devices 6, 7 in the direction A, as shown in FIG. 5, the locking devices 6, 7 will rotate about their points of rotation 8, as a result of which the closing member 11 will clear the connection portion of the slot for a movement of a headed stud from the second portion 2*b* to the first portion 2*a* in the slot. Here the stainless steel springs are not fully pressed in. The limitation of the movement is accomplished by the locking devices 6, 7 abutting against the plate-shaped part 1.

In the opened condition shown in FIG. 5, a further rotation of the locking devices 6, 7 is blocked by the stops 31.

The operation of this exemplary embodiment of the attachment device according to the invention is shown in FIGS. 6A–C. FIG. 6A shows the attachment device when it is not operated. The locking devices 6, 7 under influence of the compression springs are slightly biassed and close off the connection portion of the slot 2*a*, 2*b*. Only the large opening 2*a* of the slot 2*a* is accessible to the head 20 of the stud. When the head 20 of the stud has been inserted through the attachment device, the attachment device is moved in the direction of arrow B, as shown in FIG. 6B. Here the locking devices 6, 7 are pressed away by the stud. The locking devices 6, 7 give way to the stud which moves from the first portion 2*a* to the second portion 2*b* in the slot. The user does not need to operate the locking devices 6, 7. When the stud has passed the closing members 11 of locking devices 6, 7, the locking devices 6, 7 snap back into their non-operated position as shown in FIG. 6C. The user hears and feels a click. The headed stud is now safely locked in the second portion 2*b* of the slot.

FIG. 6C further shows that the headed 20 stud is fully confined by on the one hand the plate-shaped part 1, and on the other hand the closing members 11 of the locking devices 6, 7. Moreover the fastening is self-locking, because a pressure by the stud in the direction of the first portion 2*a*, pushes the locking devices 6, 7 only more tightly into their closed position against the stops 30. As a result the attachment device can never get detached of its own accord.

For unlocking the attachment device, the operation members 12 of both locking devices 6, 7 have to be pressed in, as shown in FIG. 7. This is a simple and user-friendly action because the operation members 12 of the locking devices 6, 7 are situated in the squeeze plane of the attachment device. Subsequently the attachment device can be moved in the direction C, as a result of which the headed 20 stud ends up in the large opening 2*a*, so that the attachment device can be taken from the stud.

A further advantage of the exemplary embodiment of the attachment device shown here is that use can be made of injection moulded parts. A first injection moulded part then forms the plate-shaped part 1, and a second injection moulded part forms the parts 6*a*, 6*b*, 7*a*, 7*b*, respectively, of the locking devices 6, 7.

It will be clear that the exemplary embodiment of the invention described above is meant to be an illustration of the invention and not meant to limit the invention. An expert will certainly be capable of designing alternative embodiments that fall within the scope of protection of the attached claims.

The attachment device may for instance also be used for other types of hoist devices or other transfer lifts.

What is claimed is:

1. Hoist device for persons comprising a lifting arm to which a headed stud is attached for attaching a hoist sling to the lifting arm, wherein the head has a larger diameter than the stud, and wherein the hoist sling comprises an attachment device for attaching the hoist sling to the lifting arm, comprising a plate-shaped part comprising:

a continuous slot situated in a plane of the plate-shaped part comprising a first portion through which the stud and its head will pass, a second portion through which the stud will but the head of the stud will not pass, and a connection portion between the first and second portion, and a locking device arranged to the plate-shaped part and movable parallel to the plane of the plate-shaped part, said locking device near a first end comprises a closing member and near a second end comprises an operation member that can be operated for bringing the closing member from a first position, in which the closing member at least partially closes off the connection portion, to a second position, in which the closing member has been slid out of the connection portion for clearing the connection portion for moving the stud from the second to the first portion in the slot.

2. Hoist device according to claim 1, wherein the locking device is rotatably attached to the plate-shaped part.

3. Hoist device according to claim 2, wherein the point of rotation is placed between the first and second end of the locking device.

4. Hoist device according to claim 1, wherein the operation member is situated near a side of the plate-shaped part.

5. Hoist device according to claim 4, wherein the operation member is operable from the side of the plate-shaped part.

6. Hoist device according to claim 4, wherein the side is situated in a longitudinal direction of the slot and lateral from the slot.

7. Hoist device according to claim 1, wherein the attachment device comprises a biassing device for biassing the locking device to the first position.

8. Hoist device according to claim 7, wherein the biassing device comprises a spring.

9. Hoist device according to claim 1, wherein the locking device is adapted for giving way from the first position to a stud which moves in the slot from the first to the second portion.

10. Hoist device according to claim 9, wherein the closing member at a side facing the first portion of the slot is provided with an inclined edge sloping in the direction of the second portion.

11. Hoist device according to claim 1, wherein the attachment device is adapted for a self-locking closing-off of the connection part by the closing member.

12. Hoist device according to claim 11, wherein the locking device is movably attached for a movement of the closing member directed away from the first portion from the first position and in which the attachment device comprises a stop for stopping a movement of the closing member directed towards the first portion from the first position.

13. Hoist device according to claim 1, wherein the engagement surface of the operation member is substantially perpendicular to the plane of the plate-shaped part.

14. Hoist device according to claim 1, wherein the attachment device comprises a stop for stopping the movement of the locking device when the closing member is moved outside of the connection portion.

15. Hoist device according to claim 1, wherein the attachment device comprises two locking devices that are placed on either side of the connection portion of the slot.

16. Attachment device for a hoist sling, with which the hoist sling is attachable to a hoist device, comprising:

a plate-shaped part provided with a continuous slot which comprises a first portion through which a headed stud fits, wherein the head has a larger diameter than the stud, a second portion through which the stud does but the head does not fit, and a connection portion between the first and second portion, a locking device which is attached to the plate-shaped part and movable parallel to a plane of the plate-shaped part in which the slot is situated, wherein the locking device near a first end comprises a closing member and near a second end comprises an operation member that is operable for sliding the locking device from a first position, in which the closing member at least partially closes off the connection portion, to a second position, in which the closing member has been slid out of the connection portion for clearing the connection portion for a movement of the stud from the second to the first portion in the slot.

17. Hoist sling provided with an attachment device according to claim 16.

* * * * *